US007605528B2

(12) United States Patent
Lin

(10) Patent No.: US 7,605,528 B2
(45) Date of Patent: Oct. 20, 2009

(54) CONDUCTIVE COMPOSITION AND APPLICATIONS THEREOF

(75) Inventor: Yu-Kai Lin, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 284 days.

(21) Appl. No.: 11/674,687

(22) Filed: Feb. 14, 2007

(65) Prior Publication Data

US 2008/0035892 A1 Feb. 14, 2008

(30) Foreign Application Priority Data

Aug. 9, 2006 (TW) ..... 95129253

(51) Int. Cl.
*H01J 1/62* (2006.01)

(52) U.S. Cl. ..... 313/491; 313/493; 313/634

(58) Field of Classification Search ..... 313/491, 313/493, 634; 445/23–25
See application file for complete search history.

(56) References Cited

U.S. PATENT DOCUMENTS 5,479,069 A * 12/1995 Winsor ..... 313/493
6,885,151 B2 4/2005 Kim et al.
2005/0130547 A1* 6/2005 Oida et al. ..... 445/24

FOREIGN PATENT DOCUMENTS

CN 1779570 5/2006

OTHER PUBLICATIONS

English language translation of abstract and pertinent parts of CN 1779570, same date as CN 1779570.

* cited by examiner

*Primary Examiner*—Joseph L Williams
(74) *Attorney, Agent, or Firm*—Thomas, Kayden, Horstemeyer & Risley

(57) ABSTRACT

A conductive composition and applications thereof are provided. The conductive composition comprises metal powder and glass powder. The diameter of metal powder ranges from 1 μm to 3 μm. The diameter of glass powder ranges from 0.5 μm to 1 μm. Weight percentage of the metal powder is from 60% to 98%. The conductive composition could be applied to manufacture the electrodes of a flat lamp.

5 Claims, 3 Drawing Sheets

CONDUCTIVE COMPOSITION AND APPLICATIONS THEREOF

RELATED APPLICATIONS

The present application is based on, and claims priority from, Taiwan Patent Application Serial Number 95129253, filed Aug. 9, 2006, the disclosure of which is hereby incorporated by reference herein in its entirety.

BACKGROUND

1. Field of Invention

The present invention relates to a flat lamp. More particularly, the present invention relates to a conductive composition used in a plat lamp.

2. Description of Related Art

Flat lamp featured by its luminescence efficiency, uniformity and large-area luminescence is usually applied to backlight module of liquid crystal display or other devices. Flat lamp comprises an upper substrate and a lower substrate which form a panel-like structure. Each of the outer surfaces of the upper substrate and the lower substrate contains an electrode layer. Each of the inner surfaces of the two substrates contains a fluorescence layer. The upper substrate and the inner substrate are attached together with a space in between. When a voltage is applied to the substrate, the gas between the two substrates will be excited and an UV light will be released. The UV light reacts with the fluorescence material in the fluorescence layer so a visible light with a specific wave length will be released. Therefore, a flat light source can be obtained by this flat lamp.

The mixture for forming electrode layer of the flat lamp is composed of metal powder, glass powder and organic solvent. The glass powder is used as a binder to bind substrate and metal powder after the organic solvent is removed. The size and amount of glass powder and metal power are about equal in the electrode layer of conventional flat lamp. Therefore, a portion of glass powder can be found on the surface of the electrode layer. After the electrode layer is formed on the glass substrate, a high temperature process is necessary to form a fluorescence layer on the other side of the glass substrate. A supporter is therefore required to support the glass substrate with the electrode layer contacted with the surface of the supporter. In this case, glass material will be softened and attached to the supporter. Once if the electrode layer and the supporter are attached together, it is very difficult to separate the glass substrate and the supporter after the glass substrate, electrode layer and fluorescence layer are cooled down. The glass substrate and the supporter are easily broken when trying to separate them.

Conventional way of manufacturing flat lamp is to form a fluorescence layer on the substrate and have them shaped into a corrugated structure, and two substrates are packaged together. The only way to form an electrode layer on the outer surface of the corrugated substrate is through soak or spraying, and then a baking process is applied to complete the processes for manufacturing the substrate of a flat lamp. However, the drawbacks of this obtained electrode layer include the thicker thickness and uneven thickness ranging from 200 μm to 250 μm. This not only increases production cost but also decreases product quality.

Therefore, a novel method for manufacturing flat lamp is necessary to be provided to avoid problems mentioned above.

SUMMARY

The present invention provides a conductive composition of a flat lamp to avoid conventional problem of low yield rate caused by easily broken glass substrate. Furthermore, this invention is able to not only form a thin film electrode layer with uniform thickness but also simplify manufacturing process and decrease manufacturing cost.

In accordance with the foregoing and other aspects of the present invention, a conductive composition which can be applied to flat lamp is provided. The conductive composition is made of metal powder, glass powder and organic solvent. The amount of the metal powder and the glass powder suspended in organic solvent is larger than 60 weight percent of the solution. The diameter of metal powder ranges from 1 μm to 3 μm. The diameter of glass powder ranges from 0.5 μm to 1 μm. The weight percentage of the metal powder in the mixture of the metal powder and the glass powder is from 60% to 98%.

In accordance with the foregoing and other aspects of the present invention, a flat lamp is provided. The flat lamp comprises two substrates, gas and a thin film electrode. The two substrates are attached together with a space in between. A fluorescence layer is formed on each of the surfaces of the substrates. Gas is in the space between the two substrates. The thin film electrode mentioned above is on two end of the substrate. The better thickness of the thin film electrode ranges from 5 μm-200 μm, and the best thickness ranges from 10 μm-50 μm.

In accordance with the foregoing and other aspects of the present invention, a manufacturing method of the substrate in the flat lamp is provided. The substrate is cleaned and a printing process is performed to form a conductive coating layer on the first surface of the substrate. Bake the substrate and sinter the conductive coating layer to form a thin film electrode on the substrate. The thickness of the thin film electrode ranges from 5 μm-200 μm, but the preferred thickness of the thin film electrode ranges from 10 μm-50 μm and the best thickness ranges from 10 μm-30 μm.

After cooling down the glass substrate and the thin film electrode, a fluorescence layer is formed on the second surface of the substrate. The glass substrate, the thin film electrode, and the fluorescence layer are then shaped into a corrugated structure so a substrate of the flat lamp can be obtained. In another embodiment of the invention, the glass substrate and the thin film electrode can be shaped before the fluorescence layer is formed.

A flat lamp can be completed by packaging two preliminary completed substrates together with the two fluorescence layers facing each other and a discharging space formed between the two substrates.

The present invention not only solves conventional broken glass problem, but also forms a thin film electrode layer with uniform thickness. The manufacturing process is simplified and manufacturing cost is lowered. Furthermore, this invention increases both product quality and yield rate.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
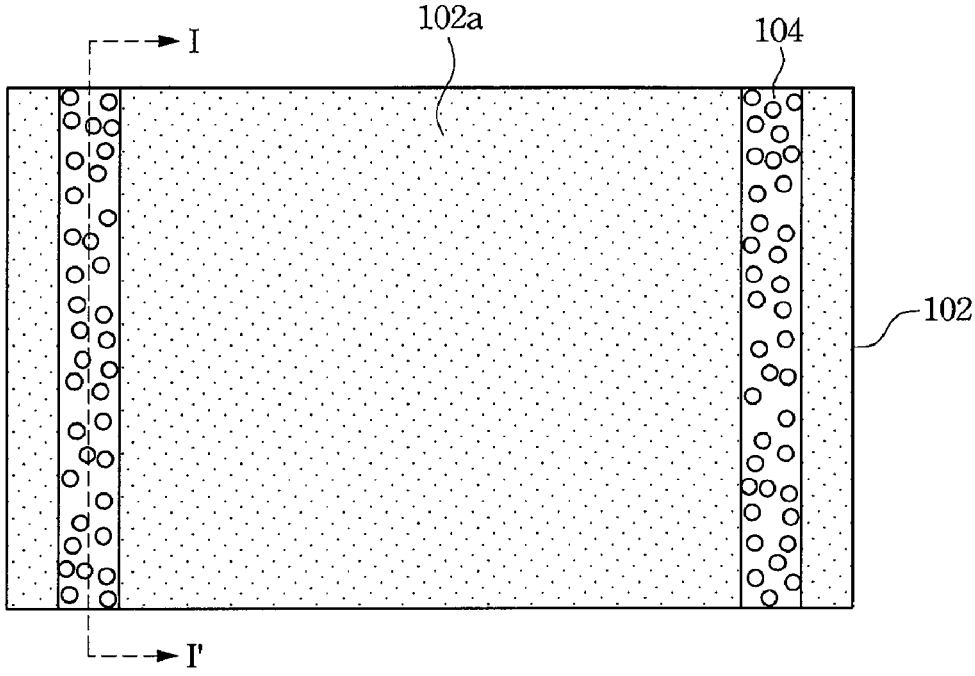
FIG. 1 is a schematic view of a glass substrate with electrode according to an embodiment of the invention.

Please refer to FIG. 1, FIG. 1 is a schematic view of a glass substrate with electrode according to an embodiment of the invention. A glass substrate 102 is cleaned and placed on a supporter (not shown in FIG. 1). A printing process is performed on the substrate to form a conductive coating layer on the first surface 102*a* of the substrate 102. Bake the substrate 102 and sinter the conductive coating layer to form a thin film electrode 104 on the substrate 102. The thickness of the thin film electrode 104 ranges from 5 μm-200 μm, but the preferred thickness of the thin film electrode 104 ranges from 10 μm-50 μm and the more preferred thickness ranges from 10 μm-30 μm.

Figure 2:
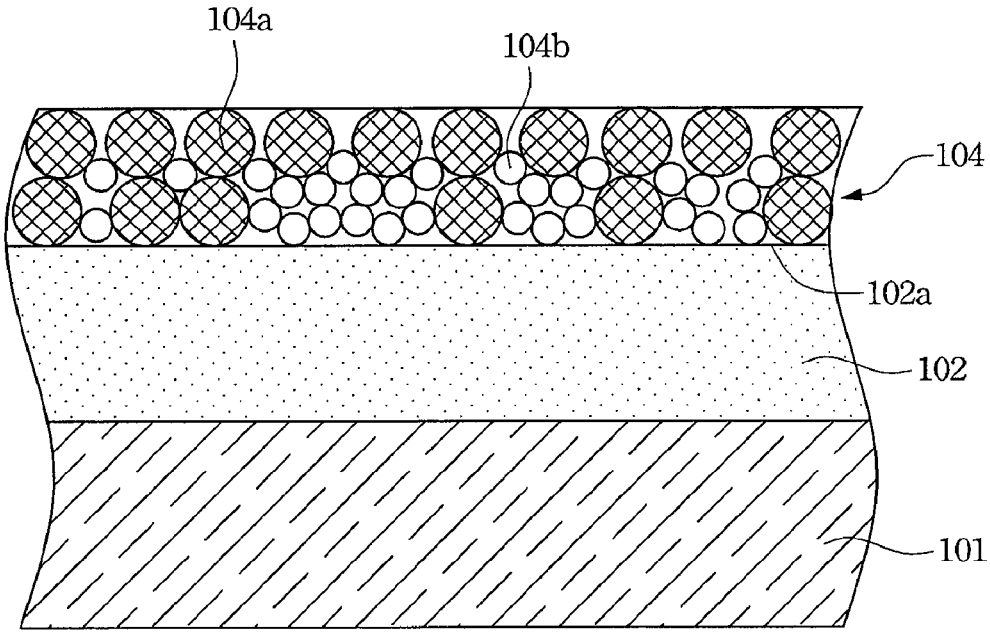
FIGS. 2-4 are cross sectional views of a substrate in a flat lamp according to an embodiment of the invention.

Please also refer to FIG. 2, FIG. 2 is a cross sectional views along I-I' shown in FIG. 1. The substrate 102 is preferably placed on the supporter 101. The thin film electrode 104 is preferably formed on the first surface 102*a* of the substrate 102.

The thin film electrode 104 is made of a conductive composition composed of metal powder 104*a*, glass powder 104*b* and organic solvent. The amount of the metal powder 104*a* and the glass powder 104*b* suspended in organic solvent ranges from 60 weight percent of the solution. The diameter of the metal powder 104*a* ranges from 1 μm to 3 μm. The diameter of the glass powder 104*b* ranges from 0.5 μm to 1 μm. The weight percentage of the metal powder 104*a* in the mixture of the metal powder 104*a* and glass powder 104*b* is from 60% to 98%. The material of the metal powder can be silver, cooper, platinum, tin or any combination thereof.

Figure 3:
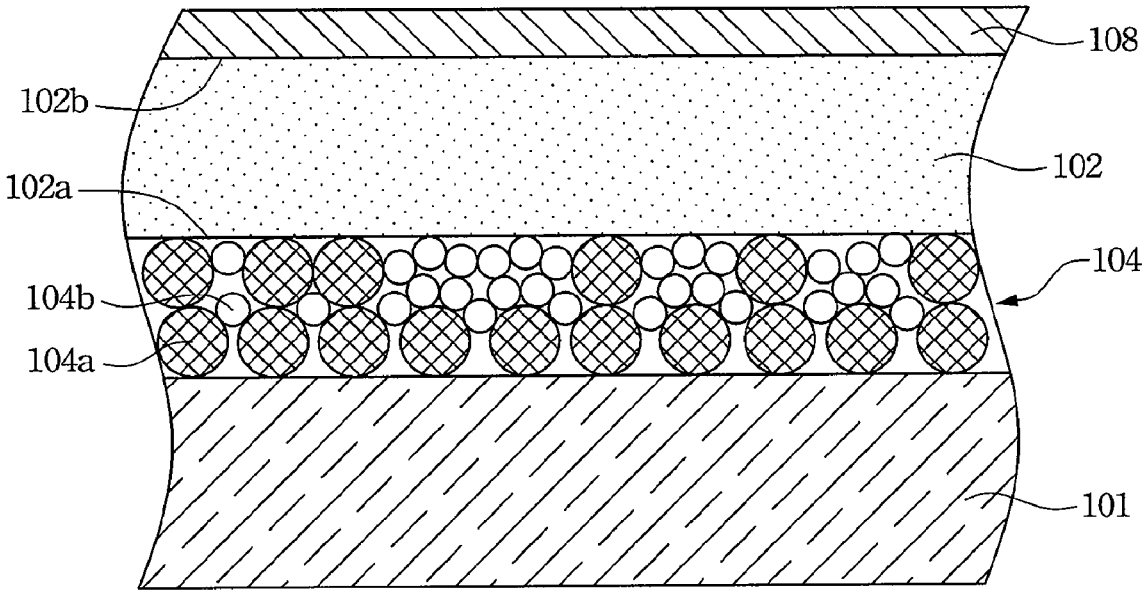

As shown in FIG. 3, after cooling down the glass substrate 102 and the thin film electrode 104, the thin film electrode 104 on the first surface 102*a* of the glass substrate 102 is contacted with the substrate 101, and then a high temperature process is performed to form a fluorescence layer 108 on the second surface 102*b* of the glass substrate 102.

Figure 4:
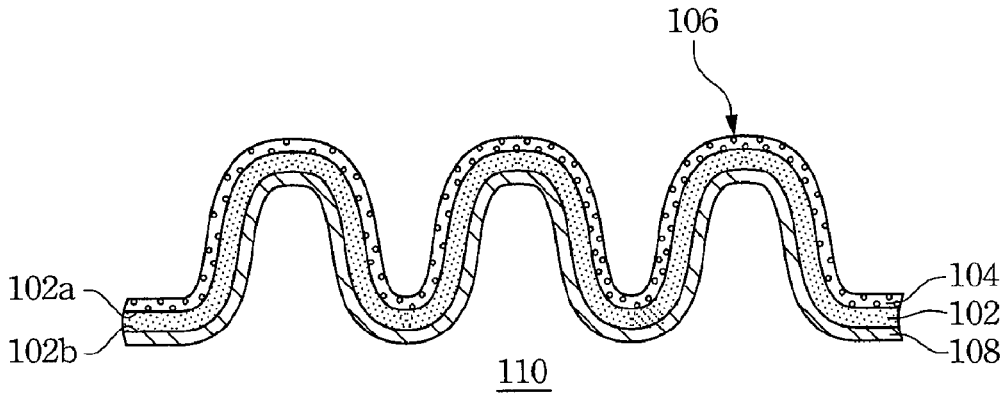

Refer to FIG. 4, the supporter 101 is removed after the fluorescence layer 108 is formed. The glass substrate 102, the thin film electrode 104, and the fluorescence layer 108 are then shaped into a corrugated structure 106 by compress molding or vacuum forming so a substrate 110 used in flat lamp can be obtained. However, the shaping method is not limited in the methods mentioned in this invention. In another embodiment of this invention, the glass substrate 102 and the thin film electrode 104 can be shaped before the fluorescence layer 108 is formed.

Therefore, an embodiment of this invention is to form a conductive coating layer by a printing process. Sinter the conductive coating layer to obtain a thin film electrode with uniform thickness, then a fluorescence layer is formed and the glass substrate, thin film electrode and the fluorescence layer are shaped. The shaping process and the fluorescence layer forming process can be done at the same time through one high temperature process. This invention not only obtains a thin film electrode with uniform thickness but also simplifies the manufacturing process.

Please refer to FIG. 2, due to the fact that the diameter of the metal powder 104*a* is larger than the diameter of the glass powder 104*b*, and the weight percentage of the metal powder 104*a* in the mixture of the metal powder 104*a* and glass powder 104*b* is from 60% to 98%. When performing the sintering process, glass powder 104*b* will be heated and softened. In this case, the glass powder 104*b* will also be deposited into the clearance in the metal powder 104*a* so the metal powder 104*a* and the glass substrate 102 will be attached together. Due to the fact that the surface of the thin film electrode 104 contacted with the supporter 101 does not contain any glass powder 104*b* or just contains very little, the thin film electrode 104 and the supporter 101 will not be attached together when performing subsequent high temperature process for forming the fluorescence layer 108. The conventional problem that the glass substrate and the supporter are easily broken can be solved when trying to separate them.

Figure 5:
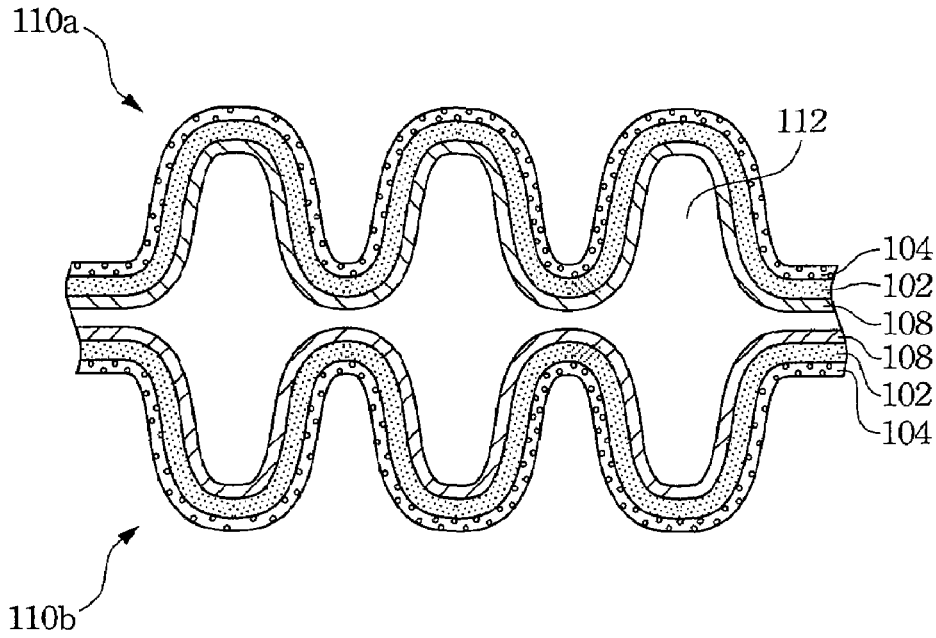
FIGS. 5 and 6 are cross sectional views of two flat lamps according to an embodiment of the invention.

In one embodiment of this invention, a flat lamp can be completed by packaging two preliminary completed substrates together with the two fluorescence layers facing each other and a discharging space formed between the two substrates. For example, as shown in FIG. 5, two identical substrates 110*a*, 110*b* are manufactured by the method mentioned above. The two substrates 110*a*, 110*b* are packaged together with a space 112 in between and the two fluorescence layers 108 of the two substrates are facing each other.

Figure 6:
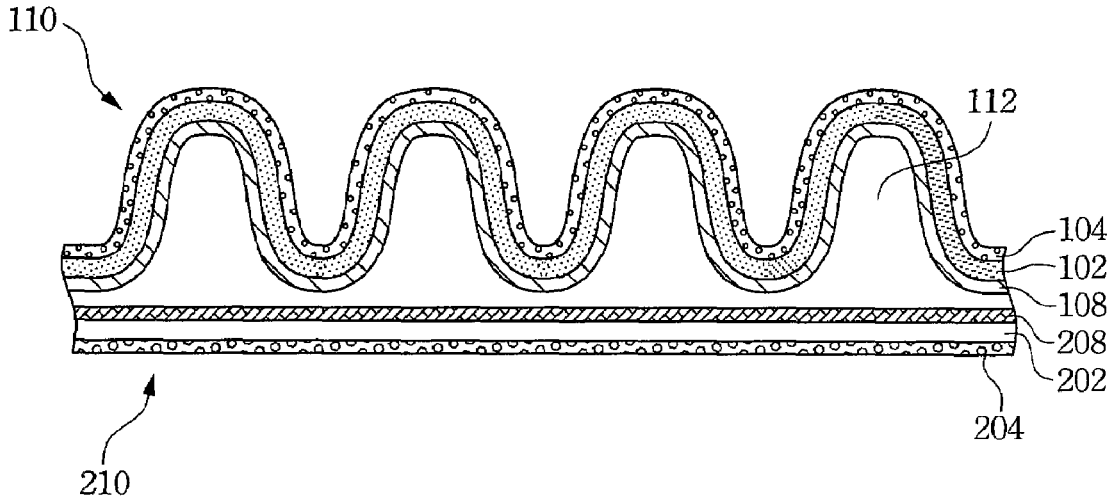

As shown in FIG. 6, a flat substrate 210 can also be used to obtain a flat lamp. The flat substrate 210 comprises a thin film electrode 204, a glass substrate 202 and a fluorescence layer 208. The flat substrate 210 and the corrugated substrate 110 are packaged together. The fluorescence layer 108 of the substrate 110 and the fluorescence layer 208 of the substrate 210 are facing each other, and the space 112 is formed between the substrate 110 and the flat substrate 210.

The present invention not only solves conventional broken glass problem, but also forms a thin film electrode layer with uniform thickness. The manufacturing process is simplified and manufacturing cost is lowered. Furthermore, this invention increases product quality and yield rate.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A flat lamp, comprising:

two substrates, a fluorescence layer on the two surfaces of the substrates, wherein the two surfaces face each other; and a thin film electrode on, at least, one surface of the substrates, the thin film electrode is made of a metal powder and a glass powder, wherein the weight percentage of the metal powder in the mixture of the metal powder and the glass powder is from 60% to 98%, and the glass powder has a diameter equals to or smaller than that of the metal powder.

2. The flat lamp of claim 1, wherein the thickness of the thin film electrode ranges from about 5 μm to 200 μm.

3. The flat lamp of claim 1, wherein the thickness of the thin film electrode ranges from about 10 μm to 50 μm.

4. The flat lamp of claim 3, wherein the thickness of the thin film electrode ranges from about 10 μm to 30 μm.

5. The flat lamp of claim 1, wherein, at least one of the substrate has a corrugated structure.

* * * * *